United States Patent [19]

Nielsen et al.

[11] Patent Number: 4,511,349

[45] Date of Patent: Apr. 16, 1985

[54] ULTRACENTRIFUGE TUBE WITH MULTIPLE CHAMBERS

[75] Inventors: Steven T. Nielsen, Sunnyvale; Carleton C. Lee, San Jose, both of Calif.

[73] Assignee: Beckman Instruments, Inc., Fullerton, Calif.

[21] Appl. No.: 583,271

[22] Filed: Feb. 27, 1984

Related U.S. Application Data

[63] Continuation of Ser. No. 395,371, Jul. 6, 1982, abandoned.

[51] Int. Cl.[3] ..... B04B 5/02

[52] U.S. Cl. ..... 494/16; 422/101

[58] Field of Search ..... 494/16, 17, 21, 19; 422/102, 101; 210/781, 782

[56] References Cited

U.S. PATENT DOCUMENTS

| | | | |
|---|---|---|---|
| 3,441,205 | 4/1969 | Young, Jr. | 233/26 |
| 3,513,976 | 5/1970 | James | 210/782 |
| 3,532,470 | 10/1970 | Rochte | 253/23 |
| 3,750,645 | 8/1973 | Bennett et al. | 128/2 G |
| 3,849,072 | 11/1974 | Ayres | 494/16 |
| 3,965,889 | 6/1976 | Sachs | 128/2 F |
| 4,015,941 | 4/1977 | Kurata | 494/16 |
| 4,040,959 | 8/1977 | Berman et al. | 210/782 |
| 4,147,628 | 4/1979 | Bennett et al. | 210/83 |
| 4,152,270 | 5/1979 | Cornell | 494/16 |
| 4,301,963 | 11/1981 | Nielsen | 233/26 |

*Primary Examiner*—Robert W. Jenkins

*Attorney, Agent, or Firm*—W. H. May; P. R. Harder; J. F. Sicotte

[57] ABSTRACT

A thin-wall centrifuge tube having multiple chambers for use in fluid sample investigation with an ultracentrifuge. More particularly, the multiple chamber ultracentrifuge tube can be used, for example, in lipoprotein separation. The ultracentrifuge tube may have two or more separate chambers which, subsequent to centrifugation, can be sealed from each other to retain the separated constituents of the sample under investigation. The chambers in the tube are joined by a constricted area which permits fluid communication between the chambers. The tube is designed to be used in conjunction with a support spacer adjacent the constriction in the tube so that the tube is properly supported during high speed centrifugation.

9 Claims, 10 Drawing Figures

ULTRACENTRIFUGE TUBE WITH MULTIPLE CHAMBERS

This is a continuation of Ser. No. 395,371 filed July 6, 1982, now abandoned.

BACKGROUND OF THE INVENTION

The present invention is directed to ultracentrifuge tubes and, more particularly, is directed to a multichamber ultracentrifuge tube.

One of the more important areas in medical research is directed to an understanding of the causes of heart attacks and strokes as the result of arteriosclerosis. Incalculable studies over many years have revealed that one of the primary causes of death or incapacitation in adults over their mid-thirties is attributable to heart attacks as well as strokes. Heart disease has reached epidemic proportion in modern civilization.

One of the important research studies being conducted in the medical field is to learn not only how to prevent the occurrence of heart attacks, but also how to predict the likelihood of a heart attack occurring for a particular individual. Such predictions will allow the patient to undergo a program to avoid the occurrence of heart attack. Large research studies have found that the quantitation of cholesterol in each of the lipoprotein density classes provides patient information that is extremely helpful in predicting the risk of coronary heart disease. The lipoproteins in the blood are classified by their buoyant density. It is generally well known that the relative magnitudes of density for the various lipoproteins can be classified as follows: very low density lipoproteins (VLDL), 0.95 to 1.006 grams per ml; low density lipoproteins (LDL), 1.006 to 1.063 grams per ml; and high density lipoproteins (HDL), 1.063 to 1.21 grams per ml.

In view of the relative gradations of density between the various lipoproteins, centrifugation provides an obvious choice to accomplish the separation of the various lipoproteins from each other under a high centrifugal force field. Therefore, lipoprotein investigation involves the utilization of a preparative ultracentrifuge after which the separated lipoproteins are subjected to analytical measurements to determine the cholesterol concentration. Since the sample is normally placed in a typical single chamber centrifuge tube for insertion in a fixed angle or vertical tube ultracentrifuge rotor, the separate bands formed during centrifugation will reorient after the centrifugation is completed. Some residue from one band may be left on the tube wall and contact other bands as they reorient to a new position affecting the purity of the separation. One type of single chamber tube used is that which is disclosed in U.S. Pat. No. 4,301,963 issued to Steven T. Nielsen on Nov. 24, 1981 and entitled "Integral One Piece Centrifuge Tube."

After centrifugation each separated lipoprotein fraction must be physically isolated so that it is not contaminated and will not result in an incorrect reading of the cholesterol concentration for that particular density lipoprotein. Typical techniques utilized to accomplish this separation are centrifuge tube slicing or aspiration. In the tube slicing technique the cutting blade must be carefully positioned and be maintained in an extremely clean condition. Furthermore, depending upon the particular type of tube utilized, a significant amount of force may have to be applied by the user to pierce the tube. Once the tube is sliced, the upper portion of the tube is isolated and the separated lipoprotein can be aspirated out of the sliced-off portion of the tube without disturbing the other separated lipoprotein bands in the remainder of the tube.

In the straight aspiration technique, bands are pipetted or suctioned off layer by layer. This operation may be simple and relatively convenient, but it poses a strong possibility of contamination. This is because lipoproteins from the removed fraction may adhere to the side of the tube and contaminate the remaining fraction.

The need exists in the process of measuring the cholesterol concentration in lipoprotein separations for a means to conveniently isolate the separated lipoproteins so that the subsequent investigation of cholesterol concentration in the separated lipoproteins can be accomplished with a minimum of effort and a minimum of contamination.

SUMMARY OF THE INVENTION

The present invention is directed to a multichamber ultracentrifuge tube. The separate chambers in the centrifuge tube are joined by a constricted area which forms a conduit to provide fluid communication between the chambers during centrifugation of the tube. A fluid sample placed into the centrifuge tube will, during centrifugation, be separated into lighter material in the chamber closest to the rotational axis of the rotor, while the heavier material will be separated into the chamber farthest from the spin axis of the rotor.

Since the chambers are divided by a constricted area having an outer dimension significantly smaller than the outer dimension of the main portion of the tube with its chambers, a support spacer is placed adjacent the constriction to provide support to the tube at the constricted area during centrifugation.

Various configurations of the constricted area are applicable to the present invention. Further, the number of separate chambers that can be formed is limited only by the length of the tube.

Use of the present invention allows an investigator of blood serum lipoproteins to accomplish an efficient separation of the various density lipoproteins without contamination. Subsequent to the centrifugation run, the constricted area of the tube can be severed and sealed to ensure the isolation of the different density lipoproteins.

DETAILED DESCRIPTION OF THE INVENTION

Figure 1:
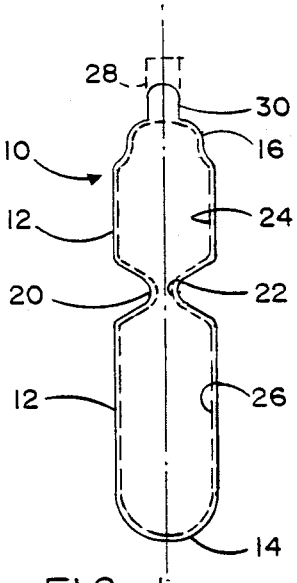
FIG. 1 is an elevational view of the ultracentrifuge tube of the present invention.

A multi-chamber ultracentrifuge tube 10 of the present invention is shown in FIG. 1 having a generally uniform cylindrical wall 12 enclosed with a hemispherical bottom 14 and a bell-shaped upper portion 16. Located between the upper portion 16 and the hemispherical bottom end 14 is a constricted area 20 forming an interior conduit 22 that provides fluid communication between an upper chamber 24 and a lower chamber 26. Positioned on the upper portion 16 is a fill port 28 which is open (shown in phantom) for receipt of a fluid sample prior to centrifugation. After the tube is filled with the sample to be centrifugated, the fill port 28 is hermetically sealed to form a solid seal 30. The tube 10 is preferably an integral one-piece tube of a thin-wall polyallomer of the type explained more fully in the above-referenced U.S. Pat. No. 4,301,963.

Figure 2:
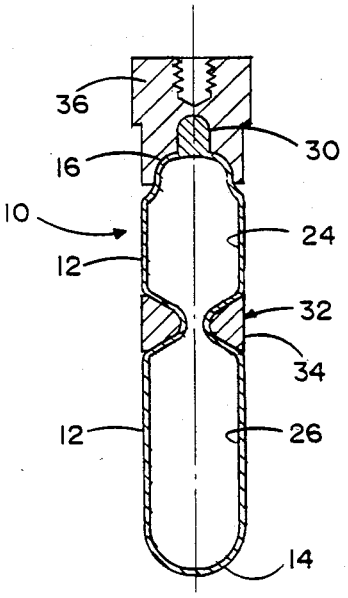
FIG. 2 is an elevation sectional view of the ultracentrifuge with an annular support spacer and a top support spacer.

As shown in FIG. 2, the centrifuge tube 10 is designed so that its constricted area 20, having the shape generally of an hour glass, compatibly receives an annular support spacer 32. The diameter of the outside surface 34 of the annular spacer is approximately the same as the diameter of the cylindrical wall 12 of the tube. The spacer 32 provides support to the thin-wall polyallomer tube 10 during centrifugation, so that there is no distortion of the tube or constriction of the conduit 22 which would affect fluid communication between the upper chamber 24 and the lower chamber 26. Positioned on the upper portion 16 of the tube is a floating spacer 36 that is designed to provide exterior support to the upper portion 16 of the tube when in a rotor during centrifugation. For further discussion concerning the floating spacer 36, reference is made to U.S. Pat. No. 4,304,356 issued to Steven J. Chulay and Steven T. Nielsen on Dec. 8, 1981 entitled "Supporting Cap for Sealed Centrifuge Tube".

Figure 3:
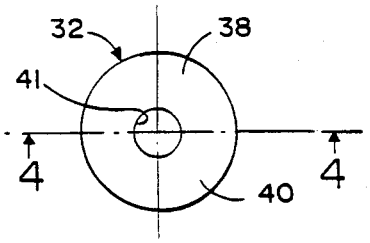
FIG. 3 is a top view of the split annular spacer of FIG. 2.
Figure 4:
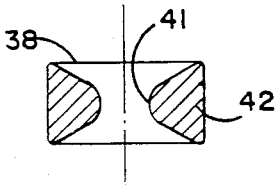
FIG. 4 is a sectional view of the annular spacer taken along the lines 4—4 in FIG. 3.

The configuration of the spacer 32 is shown in FIG. 3 with two half sections 38 and 40 that form the entire circular arrangement of the split annular spacer. The central opening 41 formed by the spacer sections 38 and 40 is approximately the same size as the exterior diameter of the constricted area 20 on the tube 10 in FIG. 1. The sectional configuration of one portion 38 of the split annular spacer 32 is shown in FIG. 4. The sectional cross area 42 is designed to occupy and conform to the constricted area 20 in the tube 10.

As explained previously, one type of fluid sample which is investigated to help predict the risk of coronary heart disease is serum lipoproteins. It is desirable to determine the amount of cholesterol found in each of the lipoprotein classes in a patient's blood serum. Since the different lipoproteins have differing density characteristics, the process of centrifugation provides the necessary separation for individual analysis and measurement of the cholesterol in each of the types of lipoproteins. In this type of an investigation, it is preferable that the centrifuge tube 10 in FIG. 1 have two chambers 24 and 26 with a constriction 20 between the chambers that forms a conduit 22 which will be large enough to allow fluid communication between the chambers. It has been found through experimentation that in a two-chamber tube the upper chamber volume should be approximately 31% of the total tube volume and the lower portion be 69% of the total tube volume. This chosen relative volume for each of the upper and lower chambers is for analysis of a serum sample to ensure that during centrifugation the very low density lipoprotein fraction will remain in the upper chamber after centrifugation, while the combination low density and high density lipoprotein fraction will remain in the lower chamber.

Figure 5:
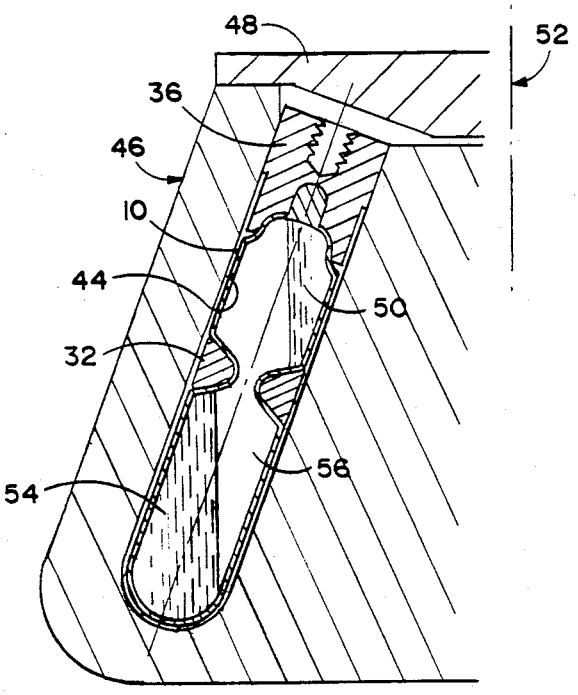
FIG. 5 is a partial sectional view of a centrifuge rotor with the present invention in place, showing the orientation of the various separated fluid sample bands during centrifugation.
Figure 6:
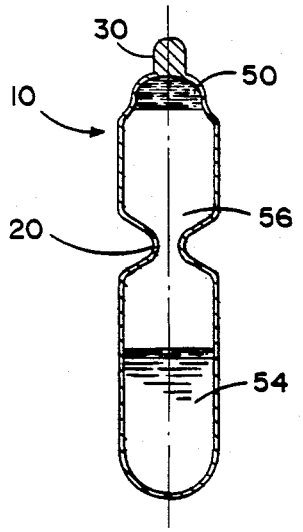
FIG. 6 shows the reorientation of the fluid sample bands in FIG. 5 when the tube is at rest in a vertical position.

Once the centrifuge tube 10 is filled with the blood sample, the fill port 28 in FIG. 1 is sealed. The tube 10 is then partially lowered into a tube cavity 44 in the rotor 46 in FIG. 5. The split annular spacer 32 is placed around the constricted area 20 of the tube 10 and the tube is lowered completely into the cavity 44 as shown in FIG. 5. The top floating spacer 36 is positioned above the tube in contact with its upper portion 16. The rotor lid 48 is placed on the rotor and the centrifugation process is initiated. During centrifugation the very low density lipoproteins 50 will band in an area of the tube closest to the spin axis 52 of the rotor 46. On the other hand, the low density and high density lipoprotein portion 54 will form a band in the portion of the tube farthest from the spin axis 52 of the rotor. As discussed above, the respective upper and lower chambers are sized so that the entire very low density lipoproteins 50 will remain in the upper chamber 24, while the low density and high density lipoproteins will remain in the lower chamber 26. The lipoprotein fractions 50 and 54 will be separated by an inner band of the blood sample 56 that does not contain any lipoproteins.

Once the centrifugation process has been completed and the lipoproteins have been separated, tube 10 is removed from the centrifuge rotor and the constricted area 20 of the tube is pinched with a clamp, hemastats or possibly heated hemastats to seal off the conduit 22 and maintain the isolation of the separated lipoprotein contents in the respective chambers. The constricted area 20 may also be pinched off by twisting one chamber 360° along its longitudinal axis with respect to the other chamber. To obtain a cholesterol value for the very low density lipoprotein fraction in the upper chamber 24, the contents from the chamber are transferred to another tube for the cholesterol analysis. There is no requirement of tube slicing or aspiration to separate the lipoprotein bands.

The content of the lower chamber 26 which contains both the low density lipoproteins and high density lipoproteins is transferred to another two-chamber tube 10 and the centrifugation process is repeated so that the lighter low density lipoprotein fraction will flow to the top of the upper chamber 24 and the heavy density lipoprotein will be in the lower chamber 26. After centrifugation, the constricted area 20 is pinched off to seal the conduit 22 and maintain the separation of the respective lipoprotein constituents.

Figure 7:
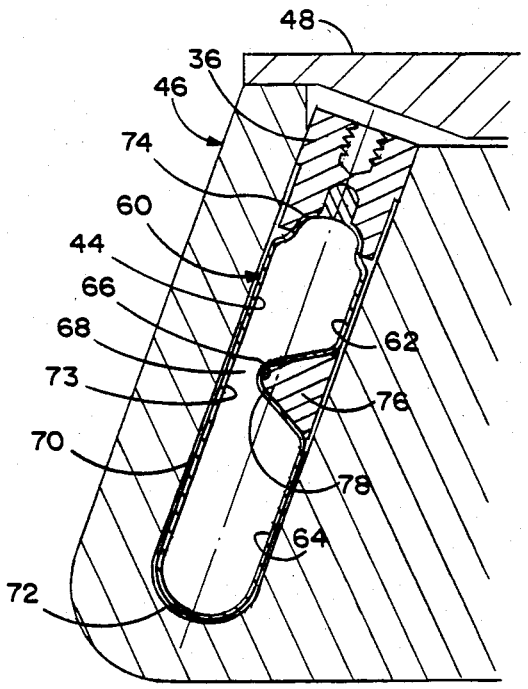
FIG. 7 shows an alternate embodiment of the present invention utilizing a wedge spacer in a centrifuge rotor with the wedge facing the spin axis of the rotor.

Attention is directed to FIG. 7 showing an alternate embodiment of the present invention wherein the ultracentrifuge tube 60 has an upper chamber 62 and a lower chamber 64 which are joined by a restricted area 66 forming a conduit 68. While the embodiment of the present invention shown in FIG. 1 has the conduit formed symmetrically around the longitudinal center of the tube 10, the embodiment shown in FIG. 7 has the conduit portion 68 closely adjacent the cylindrical wall 70 of the tube 60. The bottom hemispherical portion 72 of the tube 60 and its upper bell-shaped upper portion 74 establish an enclosed centrifuge tube. A wedge-shaped spacer 76 is placed in the constricted area 66 to form exterior support to the upper chamber 62 and the lower chamber 64 during centrifugation. The orientation of the tube 60 in FIG. 7 positions the conduit 68 so that it is as far away from the spin axis 52 of the rotor as possible. In this orientation the heavier components will move outward and collect on the straight interior wall 73 of the centrifuge tube and move smoothly into the lower chamber 64. However, the lighter material must follow a more oblique path around the wedge-shaped surface 78 of the constricted portion 66.

Figure 8:
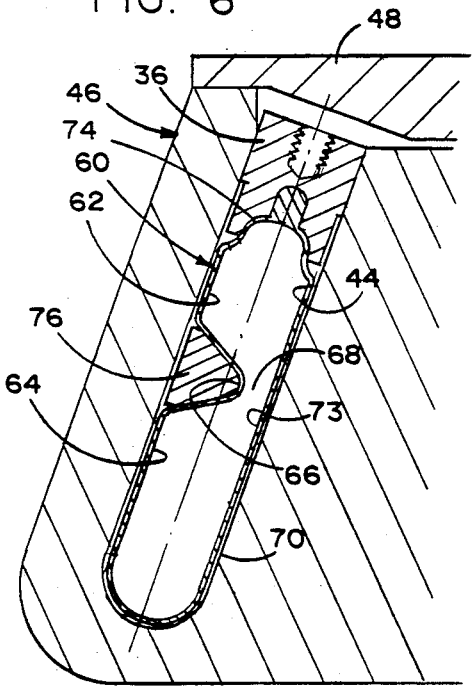
FIG. 8 is similar to the centrifuge tube shown in FIG. 7 with the wedge-shaped spacer facing away from the spin axis of the rotor.

In FIG. 8 the same centrifuge tube 60 is shown rotated 180° in the tube cavity 44 of the rotor 46 as compared to the tube position in FIG. 7. In this orientation the constricted portion 66 is oriented in a position as close as possible to the spin axis 52 of the rotor. This orientation of the centrifuge tube 60 has the advantage that the light fractions will collect on the straight surface 73 of the tube closest to the spin axis of the rotor and move smoothly up into the upper chamber 62. However, the constricted wedge-shaped portion 78 on the interior of the tube will result in a more oblique or circuitous path for the heavier fractions to move down into the lower chamber 64 which is farther away from the spin axis of the rotor.

It should be noted with respect to not only the split annular spacer 32 of the embodiment shown in FIG. 2, but also the wedge-shaped spacer 76 shown in FIG. 7 that each are preferably made of a polyphenylene oxide material known as Noryl developed by General Electric. This material is advantageous, because its density is approximately 1.06 grams per ml which is closely approximate bulk serum density. During investigation of lipoproteins this material will not cause undue pressure to be exerted on the top of the lower chamber because of the centrifugal loading of the spacer.

Figure 9:
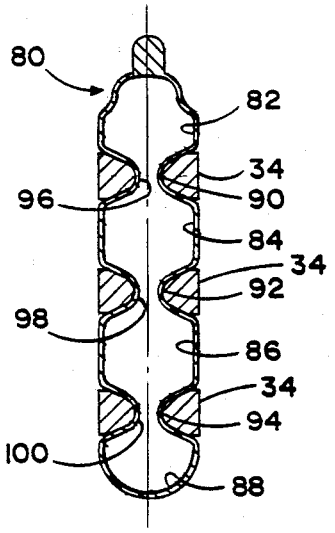
FIG. 9 is a second alternate embodiment of the present invention showing several chambers in the centrifuge tube with several annular support spacers.

Reference is made to FIG. 9 showing a second alternate embodiment of the present invention wherein the centrifuge tube 80 has four chambers 82, 84, 86, and 88. These chambers are separated by respective constricted areas 90, 92, and 94. The chambers are in fluid communication with each other by the respective conduits 96, 98, and 100. At each of the respective restricted areas 90, 92, and 94 is located a split ring spacer 34 as is shown used with the centrifuge tube 10 in FIG. 2. In particular applications depending upon the size of the centrifuge tube and the size of the respective chambers 82, 84, 86, and 88, it is possible to facilitate separation of the bands of a fluid sample into three or four zones.

Figure 10:
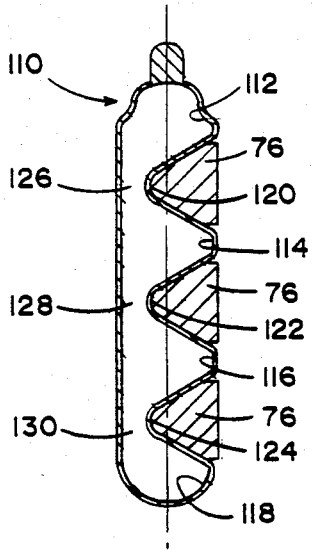
FIG. 10 is a third alternate embodiment of the present invention showing several chambers within the centrifuge tube separated by multiple wedge spacers.

Similarly, with respect to FIG. 10 the centrifuge tube 110 is shown having a plurality of chambers 112, 114, 116, and 118 which are separated respectively by constricted areas 120, 122, and 124. Each of the respective chambers 112, 114, 116, and 118 are in fluid communication with each other through the respective conduits 126, 128, and 130. The respective restricted areas 120, 122, and 124 receive wedge spacers 76 similar to that arrangement as shown in conjunction with the centrifuge tube 60 in FIG. 7. Although the alternate embodiments shown in FIGS. 9 and 10 show four chambers, it is envisioned that any number of multiple chambers could be utilized depending upon the size of the centrifuge tube and the application to which it is directed.

It should be noted that although the tube of the present invention is preferably made of a polyallomer material because of its density proximity to blood serum, it is possible to consider other thermoplastic polymers such as thermoplastic polyester, polypropylene and polyethylene.

It is envisioned that embodiments of centrifuge tubes other than those specifically shown in this application could be designed within the scope and spirit of the present invention.

What is claimed is:

1. A multi-chamber ultracentrifuge tube for placement in an ultracentrifuge inclined rotor and for centrifuging a fluidic sample, said tube comprising:

an upper cylindrical chamber;

a lower cylindrical chamber;

a constricted area joining said chambers and forming a channel between said chambers, said channel having a sectional perimeter smaller than the sectional perimeter of each of said chambers; and a spacer mounted adjacent said constricted area to support said chambers during centrifugation said spacer having a density of the order of magnitude of the density of said fluidic sample, whereby stresses on said lower chamber during ultracentrifugation are substantially avoided.

2. A multi-chamber tube as defined in claim 1, wherein said constricted area comprises a cylindrical channel having its longitudinal center aligned with the longitudinal center of said upper and lower chambers.

3. A multi-chamber tube as defined in claim 2, wherein said spacer comprises an annular ring.

4. A multi-chamber tube as defined in claim 1, wherein said constricted area comprises said channel positioned adjacent and in alignment with a portion of the wall of said upper and lower chambers.

5. A multi-chamber tube as defined in claim 4, wherein said spacer comprises a wedge-shaped spacer.

6. An ultracentrifuge tube for containing a fluidic sample comprising:

a bottom portion;

a generally cylindrical flexible wall extending upward from said bottom portion;

a top portion enclosing the end of said cylindrical wall opposite said bottom portion, said bottom portion, said cylindrical wall and said top portion being integrally formed from one piece of material;

a fill port on said top portion;

a reduced diameter area in said wall between said top and bottom portions forming an upper chamber and a lower chamber, said reduced diameter area establishing an orifice for fluid communication between said upper and lower chambers; and a support spacer mounted arund said reduced diameter area, said spacer having a density approximately equal to or less than the density of said fluidic sample.

7. A multi chamber integral one-piece ultracentrifuge tube for holding a sample comprising:

a first cylindrical chamber having a generally uniform exterior and interior cross-sectional area;

a second cylinder chamber having a uniform exterior and interior cross-sectional area approximately the same as said first chamber;

a constricted portion joining said first and second chambers and forming a conduit for fluid communication between said chambers, said constricted portion having an exterior and interior diameter smaller than said first and second chambers; and a support member placed adjacent said constricted portion to occupy the void created by said constricted portion to make the area of said tube adjacent said constricted portion have approximately the same exterior cross section as said first and second chambers, said support member having a density approximately equal to or less than the density of said sample.

8. A centrifuge inclined rotor for centrifuging a sample comprising:

a rotor body having a plurality of cavities;

an ultracentrifuge tube adapted for containing said sample mounted in one of said cavities and having a generally uniform interior cross section, said tube having a reduced cross-sectional area forming a conduit smaller than said uniform interior cross section, said conduit establishing at least two chambers in said tube wherein said chambers are in fluid communication through said conduit; and a spacer positioned adjacent said conduit to support the exterior of said tube adjacent said conduit of said tube during centrifugation, said spacer having a predetermined density approximately equal to or less than the density of said sample.

9. An ultracentrifuge inclined rotor assembly for centrifuging a sample comprising:

a rotor having a plurality of cavities;

at least one sample carrying generally cylindrical centrifuge tube placed in one of said cavities, said tube having at least two chambers divided by a reduced diameter area located at a specified position between the top and bottom of said tube, said restricted area forming an upper and a lower chamber, said reduced diameter area establishing an orifice to provide fluid communication between said chambers;

a support spacer mounted adjacent said reduced diameter area said spacer having a density equal to or less than said sample; and a support member mounted adjacent said top of said tube in said rotor.

* * * * *